United States Patent [19]

Bille

[11] 4,193,743

[45] Mar. 18, 1980

[54] OSCILLATORY PUMP FOR THE TRANSPORT OF VISCOUS MATERIALS

[75] Inventor: Heinz Bille, Unna, Fed. Rep. of Germany

[73] Assignee: Maschinenfabrik Walter Scheele KG, Unna-Massen, Fed. Rep. of Germany

[21] Appl. No.: 21,853

[22] Filed: Mar. 19, 1979

Related U.S. Application Data

[63] Continuation-in-part of Ser. No. 777,811, Mar. 15, 1977, abandoned.

[30] Foreign Application Priority Data

Mar. 17, 1976 [DE] Fed. Rep. of Germany ..... 2611124

[51] Int. Cl.[2] ..... F04C 21/00; F04B 15/02

[52] U.S. Cl. ..... 417/481; 417/519; 417/900; 92/120

[58] Field of Search ..... 417/516, 517, 518, 519, 417/481, 483, 484, 482, 900; 92/120

[56] References Cited

U.S. PATENT DOCUMENTS 3,667,653 6/1972 Loewenthal ..... 417/481 X 3,807,908 4/1974 Rossi ..... 417/481

*Primary Examiner*—Richard E. Gluck

*Attorney, Agent, or Firm*—Allison C. Collard; Thomas M. Galgano

[57] ABSTRACT

A piston pump for the transport of viscous materials and, in particular, concrete, includes a housing having defined therein an annular-shaped working space, a piston slidably mounted within the annular-shaped working space for oscillatory movement, and a pressure conduit and a suction conduit, each of which is communicative with the working space. The pump also includes control means having a member which is disposed in the annular-shaped working space for connecting the portion of the working space, which lies in front of the moving piston, to the pressure conduit and for simultaneously connecting the portion of the working space which lies back of the moving piston, to the suction conduit. In addition, the pump includes means for reversibly driving the piston so that it moves in an oscillatory manner in the annular working space, reversing its direction when it nears the member of the control means.

8 Claims, 5 Drawing Figures

OSCILLATORY PUMP FOR THE TRANSPORT OF VISCOUS MATERIALS

This is a continuation-in-part of application Ser. No. 777,811, filed Mar. 15, 1977, now abandoned.

The present invention relates to a piston pump for the transport of viscous materials, such as concrete. More particularly, it relates to a piston pump having a ring-shaped working space in which a piston is moved in a circular path and a control device, by which the working space is alternately connected to a pressure conduit in front of the motion of the piston and to a suction conduit behind the motion of the piston.

Conventionally, pumps for the transport of concrete are known having two working cylinders, disposed parallel to one another, whose inlet- and outlet-ports are regulated by a control device in such a manner that an almost continuous discharge flow results. For such concrete transport pumps, two separate working cylinders are indispensable and are furnished with two pistons, moving to and fro therein. In order to increase the continuity of delivery and also to minimize the wear, the length of the working cylinders is chosen very large, so that comparatively large transport strokes result.

In order to save space while improving the continuity of the transport flow, concrete pumps with a circular working space having been proposed, in which a piston is moved along a circular path. In this manner, large transport strokes may be effected in a relatively small space. The concrete pumps, known according to the state of the art (see, for example, German OS No. 19 41 409,) have a circular working space in which at least one piston runs in an uninterrupted circular motion and regulatory means, which alternately connect the working space to a pressure conduit in front of the moving piston and to a suction line behind the moving piston.

These prior art piston pumps of the type having a circular working space have the disadvantage that the regulatory means includes parts which protrude into the working space, which have to be retracted out of the working space when the piston passes by. Alternatively, the piston may be retracted radially when it passes by the regulatory means. In both cases, packing problems arise when the piston passes by the regulatory means, which are difficult to cope with when an abrasive material like concrete is being handled.

For this reason, transport pumps for concrete with a circular working space are not popular, despite their advantageous constructions, which allows such a large length of working space in such a small space.

Accordingly, it is an object of the present invention to provide an improved piston pump of the aforementioned kind which eliminates packing problems, despite the provision of a circular working space and the use of abrasive materials.

In accordance with the object of the invention, a piston pump of the aforementioned kind having a circular working space is provided, wherein the piston is reversibly driven, in which case the two reversion points of the piston are disposed immediately in front and behind the control or regulatory means, which means interrupts the circular shape of the working space by a control element or a partition.

When the piston is driven reversibly, the piston and the regulatory means which protrude into the working space, do not disturb each other. Therefore, the regulatory means may easily be built, e.g., like in a conventional, two-cylinder pump. As a result, time-tried constructions are available, which also work well with abrasive materials. The section of the circular working space which lies in front of the motion of the piston, serves as the working space for the discharge stroke while, simultaneously, the section which lies behind the motion of the piston, serves as working space for the intake stroke. For each intake stroke, which is simultaneously also the discharge stroke, the whole length of the circular working space is available. Most advantageously, one does not have to take into consideration the shape and the material of the piston when furnishing the regulatory means, as a result of which one may use as a piston even, e.g., a wear-resistant and self-sealing rubber piston. Such a self-sealing piston is particularly important in a concrete pump because very small leaks cause a pressing out of water from the transported material. This loss of water causes the formation of a solid plug, which increases wear and which causes plugging-up of the downstream system of pipes. A further advantage is that the pump may be driven easily forwards or backwards, whereby the pump may draw in through the pressure line, and urge back into the suction line, the material to be transported. This method of operation is needed in order to be able to empty the transport system which is connected downstream. Such a reverse procedure is not possible on conventional piston pumps with a circular working space.

According to a preferred embodiment of the present invention, the regulatory means includes a two-bladed wing flap, which is driven to and fro by a flapshaft, disposed in the area of the working space. In this case, the connecting pipe for the pressure line and the connecting pipe for the suction line are oppositely disposed, radially to the working space. Such two-bladed wing flaps have worked well when regulating the flow of the concrete in two-cylinder concrete pumps. The use of such a wing flap in a pump of the aforementioned kind is particularly advantageous, because it allows a space-saving disposition of the connecting pipes and because the rerouting of the material to be transported in the area of the regulatory means may be particularly advantageously organized.

Alternatively, the regulatory or control means may include a partition which divides the working space. On both sides of this partition, the working space runs into two connecting pipes, disposed parallel to one another which are capable of being alternately connected to a pressure conduit and a suction conduit by means of a conventional, flat gate or slide valve, rotary slide valve, or flap valve. This practice advantageously eliminates the provision of parts which might protrude into the working space.

Most desirably, the working space is disposed in a body having a ring-shaped cross-section and the upper recess of this body is closed by a cover, which is also ring-shaped. On the underside of this cover is disposed a circularly-driven drive-ring which carries a piston, projecting downwardly into the recess of the ring-shaped body. This construction allows facile mounting and dismounting, thus permitting an easy exchange of worn parts. Furthermore, the center of the ring is advantageously kept free of drive means and bearing means, so that the pressure- and/or suction-conduits or pipes may be led through the center of the ring. Preferably, the drive-ring is mounted with axial ball bearings upon the cover and is packed with O-rings or loop gaskets, against the ring-shaped body. Advantageously, the drive ring includes a groove which is also covered on top by the ring-shaped cover. On one sidewall of this groove, a gear ring is provided, which mates with the driving pinion of a hydraulic drive-motor fastened to the cover. This construction of the drive is particularly advantageous because all of the moving parts are disposed on the inside, rather than on the outside of the pump.

The groove in the drive ring is filled with pressurized oil in order to lubricate the drive means. This pressurized oil simultaneously prevents the concrete from oozing from the working space into the area of the bearings and the drive means of the drive ring. In order to exchange parts easily, the piston is detachably fastened by screws on the drive ring. In order to allow the substitution of a piston without removing the cover of the ring-shaped body, the control means may be removed from the circular shape of the working space and the piston is movable into the area of the removed control means, when dismounting is desired.

Other objects and features of the present invention will become apparent from the following detailed description when taken in connection with the accompanying drawings which disclose several embodiments of the invention. It is to be understood that the drawings are designed for the purposes of illustration only, and are not intended as a definition of the limits and scope of the invention disclosed.

In the drawings, wherein similar reference numerals denote similar elements throughout the several views.

Figure 1:
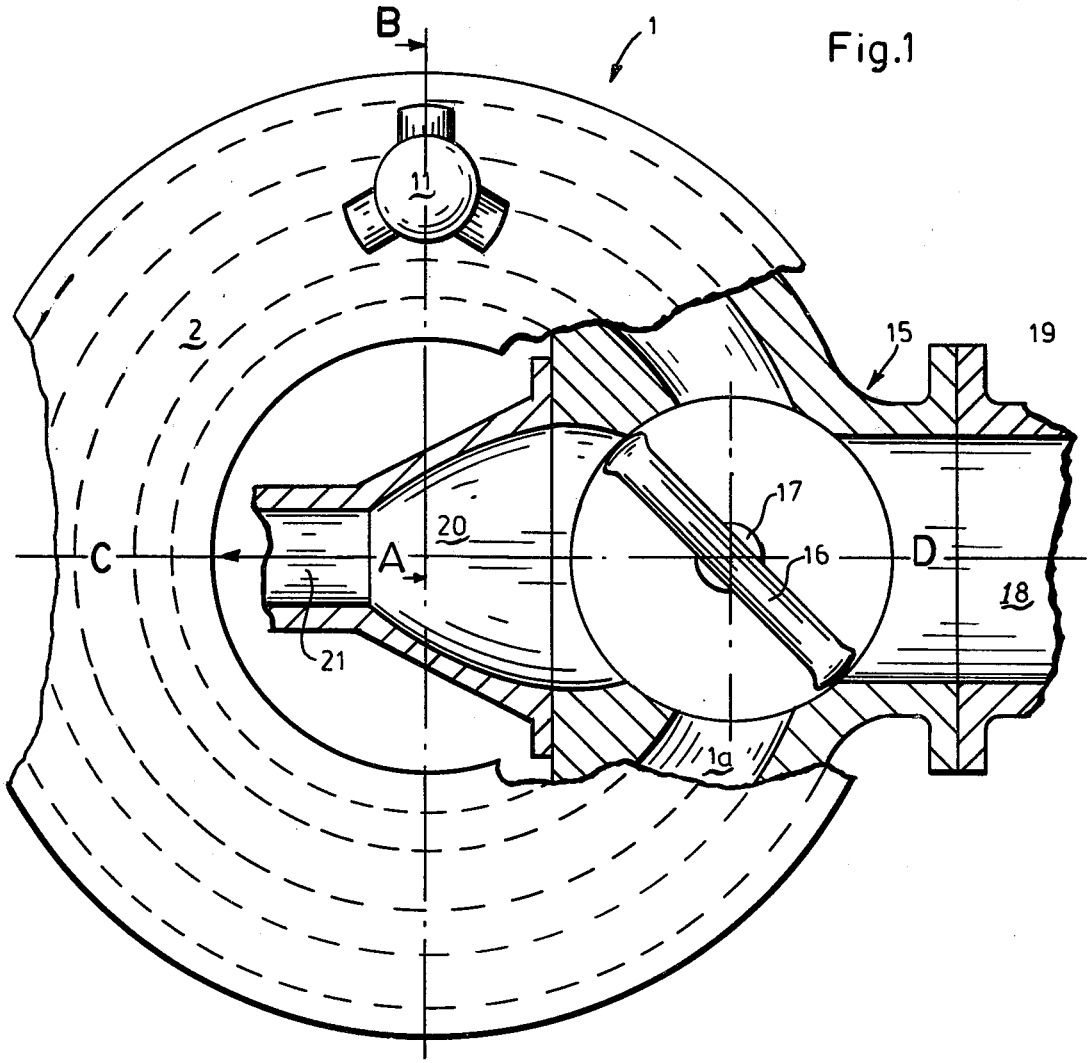
FIG. 1 is a fragmentarily-illustrated plan view of a piston pump embodying the present invention, partly in elevation and in section.

Turning now in detail to the appended drawings and, in particular, FIG. 1 thereof, therein illustrated is a concrete pump embodying the present invention, which includes a ring-shaped body 1 which has a generally U-shaped cross-section on which a ring-shaped cover 2 is screwed. Cover 2 abuts the ring-shaped body 1 by ring-shaped projections 3, 4 and covers the ring-shaped recess of ring body 1, which recess forms the working space 1*a* of the pump. Ring-shaped projections 3,4 are provided with rounded support shoulders 3*a*, 4*a*, upon which the balls of two axial ball bearings 5 and 6 run. The balls of axial ball bearings 5,6 also run upon a drive ring 7, abutting therebelow. Drive ring 7 has on its upper side a ring-shaped groove 8, which, in turn, is covered on its upper side by cover 2 and on whose outer sidewall an inwardly-directed gear ring 9 is disposed. The drive pinion 10 of a hydraulic motor 11 engages gear ring 9. Motor 11 is mounted upon cover 2. Drive ring 7 is provided with O-ring-gaskets or loop-gaskets 12, which abut against ring-shaped body 1 and projections 3,4. Ring-shaped groove 8 in drive ring 7 is filled with pressurized oil.

A rubber piston 14 is fastened to the underside of drive ring 7 by screws 13. Piston 14 is movable within working space 1*a* of ring-shaped body 1 by rotation of drive ring 7. The outer sides of rubber piston 14 fit tightly between the walls of working space 1*a*.

Ring-shaped working space 1*a* is interrupted by a control device, generally designated by the numeral 15, which serves to connect the section of working space 1*a*, which lies in front of the moving piston (which serves as the working space for the discharge stroke) to the pressure conduit of the pum and, simultaneously, serves to connect the section of the working space 1*a*, which lies behind the moving piston (which serves as the working space for the suction stroke,) to the suction conduit of working space 1*a*.

Figure 3:
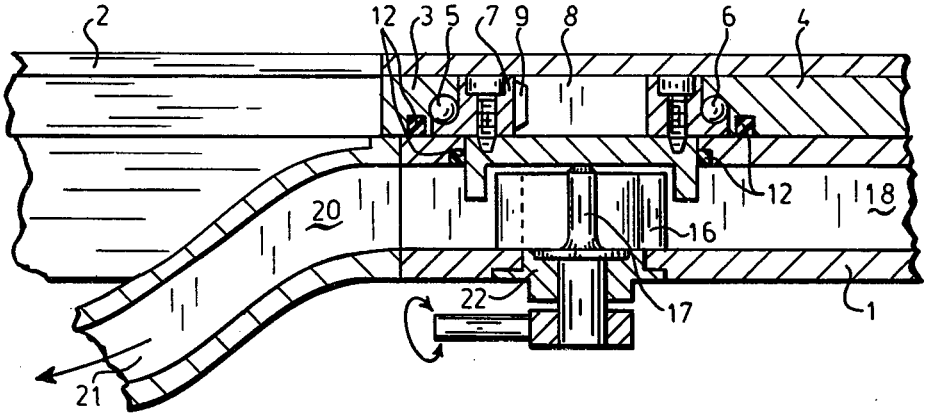
FIG. 3 is a cross-sectional view, partly in elevation, taken along line C–D of FIG. 1.
Figure 2:
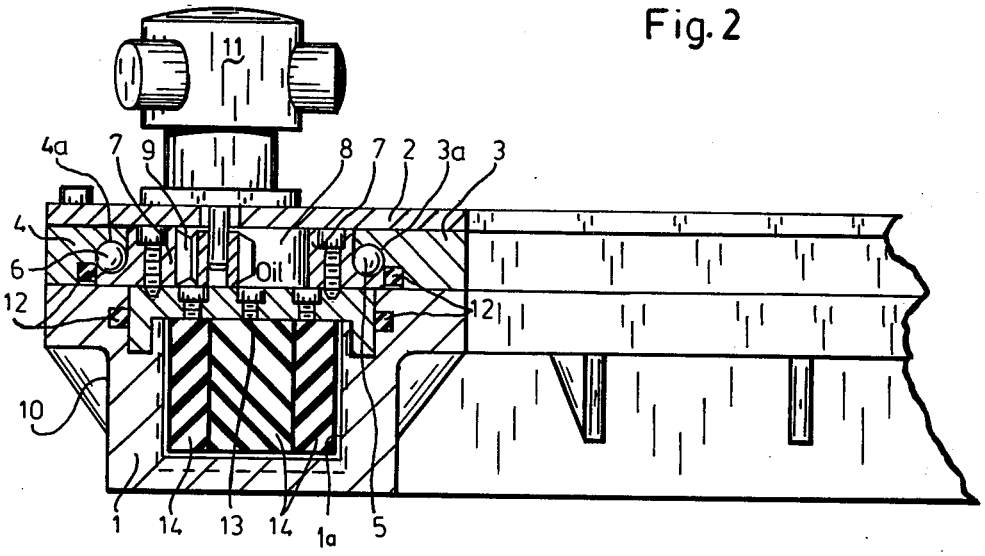
FIG. 2 is a cross-sectional view, partly in elevation, taken along line A–B of FIG. 1.

In the embodiment shown in FIGS. 1–3, the control device 15 includes a two-bladed flap 16, which is supported on a oscillating control shaft 17. A suction conduit 17, disposed radially outwardly of ring-shaped body 1 and adjacent to wing flap 16, may communicate with working space 1*a* by means of a connecting pipe 18. Opposite connecting pipe 18, the working space 1*a* is linked up in an inwardly-radial direction to a pressure pipe 20 and a pressure conduit 21.

Relative to the direction of motion of the piston, a rotation of wing flap 16 by means of control shaft 17, will connect the section of the working space which provides the working space for the discharge stroke, to the pressure pipe 20, and it will connect the section of the working space which provides the working space for the suction stroke, to the connecting pipe 18. The piston 14 is driven by the hydraulic motor 11 to and fro, actuated by drive ring 7, so that it always reverses its direction shortly before reaching the control mechanism.

Control shaft 17 of control mechanism 15 is supported by a plate 22, which is screwed on to ring-shaped body 1 from underneath. After loosening this plate 22, wing-flap 17 may be pulled downwardly out of the area of the working space 1*a*. When wing flap 17 has been removed, rubber piston 14 may be moved into the space which has been freed from the control mechanism, a position which is farther than its usual reversal point. In this position, rubber piston 14 may be removed from drive ring 7 by unscrewing screws 13, as a result of which it will fall down through the opening, effected by removal of plate 22.

By reversing this sequence but in the same manner, a new piston may be introduced without removal of cover 2 from ring-shaped body 1. The extractable control mechanism 15 thus allows a particularly simple substitution of rubber piston 14.

Figure 4:
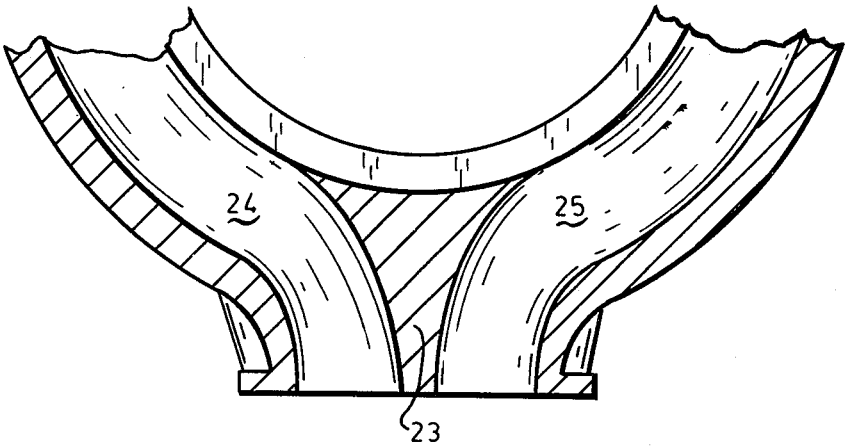
FIG. 4 is a view of a portion of another embodiment of the control means employed in the pump illustrated in the foregoing figures.

Another embodiment of control mechanism 15 is shown in FIG. 4. Here, control mechanism 15 includes a partition 23, which interrupts working space 1*a*. The working space 1*a* communicates at both sides of partition 23 with two parallel connecting pipes 24 and 25. These two connecting pipes 24, 25 are alternatingly connected to a suction conduit and a pressure conduit by a flat gate or side valve, a rotary slide view, or a flap valve, as known, e.g., in conventional two-cylinder concrete pumps.

Figure 5:
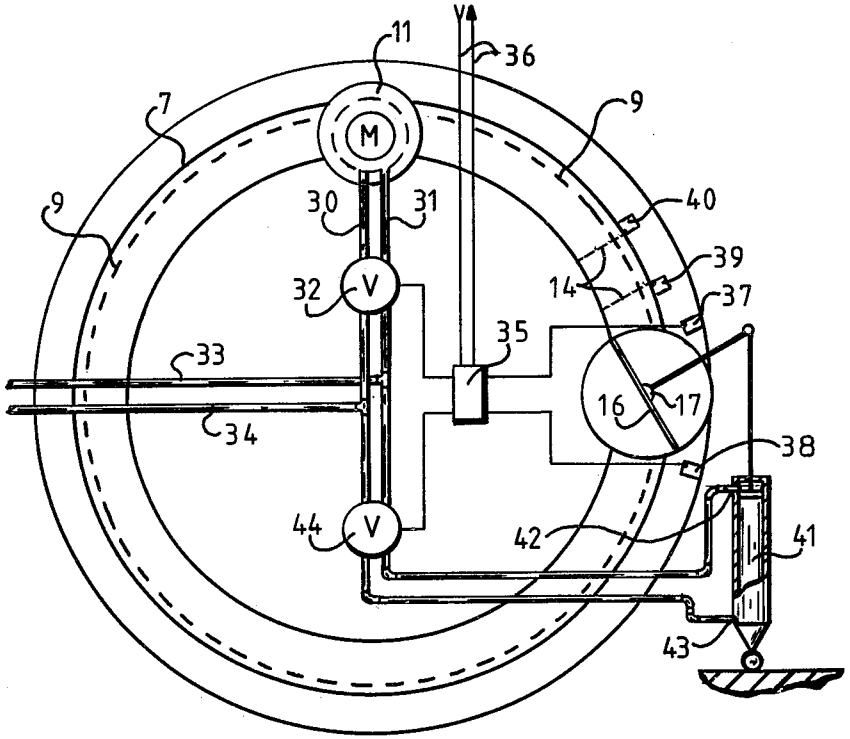
FIG. 5 is a partially schematic top plan view of the hydraulic drive and control means for the piston and control flap.

FIG. 5 illustrated a preferred embodiment of the hydraulic drive and the associated control means. Hydraulic motor 11 is provided with two connecting lines 30 and 31 for the hydraulic medium or liquid. When the hydraulic medium is applied via connection line 30, the hydraulic motor shaft rotates in a clockwise direction. When the medium is supplied via connection 31, the hydraulic motor shaft turns in a counterclockwise direction. Connection lines 30 and 31 are coupled via a return valve 32 to a hydraulic medium supply line 33 and a return line 34. The control pulses for return valve 32 are emitted from an electric control device 35, which is coupled with a supply line 36 for supplying electric current and with two limit switches 37 and 38, which are mounted at opposite ends of the travel path of piston 14 on cover plate 2 and are actuated by drive ring 7 and its associated switching elements 39 and 40.

The turning of control shaft 17 of the two-bladed or impeller flap 16 is carried out by a two-way or double-action hydraulic cylinder 41, having two connection lines 42 and 43 for the hydraulic medium, which may be coupled to the pressure supply line 33 for the hydraulic medium or to the return line 34 by means of return valve 44. The return control for return valve 44 is carried out by electric pulses, which are also emitted from the electrical control device 35.

As soon as one of the switching elements 39 or 40, carried by drive ring 7, reaches one of the associated limit switches 37 or 38, electrical control device 35 emits control pulses to the two return valves 32 and 44, so that the impeller flap 17 is pivoted into its opposite direction, and the direction of movement of piston 14 is reversed.

While only several embodiments of the present invention have been shown and described, it will be obvious to those persons of ordinary skill in the art, that many changes and modifications may be made thereunto, without departing from the spirit and scope of the invention.

What is claimed is:

1. A piston pump for the transport of viscous materials and, in particular, concrete, comprising:

a housing including a ring-shaped body having a U-shaped cross-section which has defined therein an annular-shaped working space, and a ring-shaped cover which closes said working space;

a piston, slidably mounted within said annular-shaped working space, for oscillating movement;

a pressure conduit and a suction conduit, each of which is communicative with said working space;

control means for connecting the portion of said working space which lies in front of the moving piston, to said pressure conduit and for simultaneously connecting the portion of said working space which lies in back of the moving piston, to said suction conduit, said control means including a member which is disposed in said annular-shaped working space; and means for reversibly driving said piston so that said piston moves in an oscillating manner in said annular working space, reversing its direction when said piston nears said member of said control means disposed in said annular-shaped working space, said means for driving including a drive ring, slidably supported on the underside of said cover, to which said piston is secured, said piston projecting downwardly therefrom into said working space of said body.

2. The piston pump according to claim 1, additionally including a pair of connector pipes, disposed opposite one another, one of which is disposed radially inwardly of said working space and the other of which is disposed radially outwardly of said working space, with one of said pipes connecting said pressure conduit to said working space and the other of said pipes connecting said suction conduit to said working space, and wherein said member of said control means comprises a two-bladed wing flap and said control means comprises an oscillating flap shaft on which said wing flap is mounted, said shaft being reversibly, rotatably driven so that said wing flap alternatingly connects the portion of said work space on the opposite sides thereof with said pressure and suction conduits through said connecting pipes.

3. The piston pump according to claim 1, wherein said drive ring is slidably supported on said cover by means of axial ball bearings, and said drive ring has O-rings or loop gaskets which abut against said body.

4. The piston pump according to claim 1, wherein said drive ring has an outwardly-opening, radially-extending channel formed therein, which is covered from above by said cover, and a gear ring is mounted on the sidewall of said channel, and wherein said drive means includes a drive motor mounted on said cover, and a drive pinion coupled to said drive motor, which is disposed in said channel and in meshing engagement with said gear ring.

5. The piston pump according to claim 1, wherein said channel of said drive ring is filled with pressurized oil.

6. The piston pump according to claim 1, wherein said piston is detachably mounted by screws to said drive ring.

7. The piston pump according to claim 6, wherein said control means is removably mounted on said body.

8. The piston pump according to claim 1, wherein said piston is fabricated from rubber.

* * * * *